US005411250A

United States Patent [19]

Belec et al.

[11] Patent Number: 5,411,250

[45] Date of Patent: May 2, 1995

[54] TURN-UP AND ALIGNMENT APPARATUS

[75] Inventors: Eric A. Belec, Southbury; William D. Toth, Milford, both of Conn.

[73] Assignee: Pitney Bowes Inc., Stamford, Conn.

[21] Appl. No.: 152,793

[22] Filed: Nov. 15, 1993

[51] Int. Cl.[6] ..... B65H 29/00

[52] U.S. Cl. ..... 271/185; 198/405; 198/412

[58] Field of Search ..... 198/405, 412; 271/184, 271/185, 186

[56] References Cited

U.S. PATENT DOCUMENTS

| | | | |
|---|---|---|---|
| 3,542,184 | 11/1970 | Ruckman | 198/405 X |
| 4,226,324 | 1/1988 | Stocker . | |
| 4,569,620 | 2/1986 | Lynch | 198/405 X |
| 4,685,553 | 8/1987 | Jennings | 198/405 |
| 4,705,157 | 10/1988 | Bowles . | |
| 5,169,138 | 12/1992 | Cordes | 271/184 X |

*Primary Examiner*—H. Grant Skaggs
*Attorney, Agent, or Firm*—Charles R. Malandra, Jr.; Melvin J. Scolnick

[57] ABSTRACT

The present invention provides an apparatus and method for receiving flat articles having a top edge alignment and horizontal orientation and transporting the articles along a transport path to a vertical orientation and a bottom edge alignment. The apparatus comprises a frame, a deck plate adjustably mounted to the frame, and structure for adjusting the position of the deck plate in a direction transverse to the paper path. A pair of entrance pulleys and exit pulleys are each mounted to the deck plate. The entrance pulleys rotate on a horizontal axis and the exit pulleys rotate on a vertical axis. First and second flexible, endless belts, are each wrapped around one of the entrance pulley and the exit pulleys wherein the belts complete a 90 degree twist from the respective entrance pulley to the respective exit pulley. The apparatus further comprises structure for driving the exit pulleys to move the first and second belts in the same direction and at the same velocity for transporting the articles from the entrance location to the exit location, wherein the driving structure is mounted under the deck plate.

9 Claims, 7 Drawing Sheets

TURN-UP AND ALIGNMENT APPARATUS

FIELD OF THE INVENTION

The invention disclosed herein relates generally to apparatus for handling envelopes, and more particularly, to apparatus for turning a envelope from horizontal position to a vertical position.

RELATED APPLICATIONS

The present application is related to U.S. Applications Ser. Nos. 08/152,802, 08/152,791, 08/152,790, and 08/152,787, filed concurrently herewith and assigned to the assignee of the present invention.

BACKGROUND OF THE INVENTION

In most conventional inserting machines each mail piece is processed along a horizontal path after the insertion function has been completed. Such horizontal processing is typically necessary so that a postage meter can affix or print postage on the stuffed envelope comprising the mail piece. However, once postage has been applied to the envelope, the envelope is generally conveyed to a stacking device as the envelope leaves the inserting machine. In some cases, the envelope is conveyed to a horizontal stacking device from which an operator removes a stack of envelopes when the stack reaches a certain number of envelopes. The removed stack may then be manually placed in a mail tray that will be sent to the postal service. In this manner, the user can take advantage of lower postal rates which are provided to users that tray envelopes according to some predetermined criteria.

It is known to stack mail pieces on edge after being processed on an inserting machine. For example, an on-edge stacker is disclosed in U.S. Pat. No. 5,201,504. There are certain advantages in stacking the mailpieces on edge. In particular, the stacks of mailpieces can be stacked at higher densities before an operator needs to be involved. Typically, on-edge stacking can be processed at a higher speed and the stacks are more easily transferred to mail trays that can be used later during the processing of the mailpieces by the postal service. Before such on edge stacking devices can be used to process mailpieces output from a typical inserting machine, it is necessary to change the orientation of the mail pieces from horizontal to vertical.

An example of a device for turning articles such as envelopes 90 degrees as the articles move from an entrance location to an exit location is disclosed in U.S. Pat. No. 4,705,157. The device includes a pair of flexible endless belts each having a span contiguous to a corresponding span of the other. A pair of entrance and exit roller/pulleys have the flexible belts wrapped around them. The entrance roller/pulleys are opposed but offset such that the envelope begins to turn immediately upon being engaged by the pulleys and belts. Idler rollers, commonly referred to as steering rollers, assist in keeping the belts properly positioned on the entrance and exit roller/pulleys.

A significant discontinuity exists when traditional envelope insertion equipment is interfaced to high speed mail stacking equipment. Since inserters generally provide the ability to apply postage to mailpieces being processed, the orientation of the mailpiece produced by an inserter is typically horizontal, with the top edge of the envelope registered along a registration wall. Such orientation and registration is necessary because the indicia must be placed in the top right-hand corner of the envelope regardless of the envelope depth. As different envelope sizes are processed by the inserter, the top edge of each envelope is always registered and the bottom edge position varies from envelope size to envelope size.

The variation in bottom edge position produces difficulties when an attempt is made to interface traditional insertion systems with high speed mail stacking devices which typically are "on-edge" stacking devices. Not only do such on-edge stacking devices process mail in a vertical orientation (as opposed to the horizontal orientation of inserter output), but they also process the mail with each mailpiece bottom edge justified. Since inserters produce various mail runs which vary in envelope size and thus with inconsistent bottom edge positioning, the mail must not only be changed to a vertical orientation, but also realigned so that its bottom edge is justified against a common surface before entering any form of on edge stacking device.

One logical solution would be to separate the reorientation process into two discrete steps; realign each mailpiece produced by an inserter to a consistent bottom edge registration wall and then use a conventional 90 degree turn up device to reorient each envelope to a vertical plane. At the conclusion of these two steps any mailpiece, regardless of size would positioned be appropriately to enter an on-edge stacking device. Although this two step approach would work, there are several inherent disadvantages to the aligning process contained in such an arrangement. First, horizontally disposed alignment devices generally contain paper manipulations that skid mailpieces up against a registration surface and then constantly apply urge forces, foe example by belts, rollers, pulleys, etc., to transport them along a registration wall. The urging forces may not only serve to distort and buckle each mailpiece, but inherent in these forces are relative motions that may disturb the envelope seal which has not had an opportunity to dry. Additionally, the skidding motions needed to transport the mailpiece from a top edge registration to a bottom edge registration edge would not be considered good paper handling practice. The entire alignment process would lack good paper handling control. Finally, such two step alignment requires an additional bottom edge alignment device that adds to the overall size of the equipment processing the mailpieces.

It an object of the present invention to provide a simple and reliable turn-up alignment device that simultaneously turns envelopes from a horizontal to a vertical orientation and performs the bottom edge registration.

It is a further object of the present invention to provide a turn-up and alignment device that can be coupled to the output end of an inserting machine.

It is yet a further object of the present invention to provide a turn-up and alignment device that can easily be adjusted to handle various sizes of envelopes.

SUMMARY OF THE INVENTION

The present invention provides a simple, low cost, highly reliability method of turning articles with continuous motion from a top edge, registered, horizontal orientation to a bottom edge, registered, vertical orientation. The present invention is suitable for use in a great variety of applications, including finished envelopes output from an inserting machine. This device is especially important as an interface between traditional inserting equipment and "on-edge" mail stacking devices.

In accordance with the present invention an adjustable flat belt, 90 degree turn-up transport is laterally positioned to process any size mailpiece that is received from an inserter (or inserter finishing device) in a top edge registered horizontal orientation to be deposited in a vertical orientation with its bottom edge justified against a fixed surface. In the manner described below, the mailpiece is transported between dual belts at all times to maintain total paper handling control. This is an especially important process with respect to inserters with postage meters.

It has been found that the flat belt turn-up device can be laterally adjusted to simultaneously turn and bottom edge register a full size of mailpieces received from an inserter or other mail finishing equipment. The turn-up device receives the mailpieces in a top edge, registered, horizontal orientation and deposits the mailpieces in a vertical orientation with its bottom edge registered against a fixed surface.

The present invention requires fewer parts than conventional turn-up devices because the present invention does not include steering rollers. Conventional turn-up devices have pulleys with centerline crowns and use steering rollers to keep the twisting belts on the pulley. It has been found that the need for steering rollers can be eliminated by using offset crowns on the horizontal entrance pulleys and maintaining all pulleys stationary. It has also been found that by offsetting both the entrance pulleys and the exit pulleys, the pulleys can be stationary.

It has been found that the present invention provides reliable 90 degree turn-up of flat articles which are being transported along a horizontal plane. The articles enter horizontally into a "soft" nip of a stationary pulley and an idler roller and the articles are sandwiched between the belts for the entire 90 degree twist, i.e. the belts are not offset during the twist as in other conventional turn-up devices. Further, the present invention has been found to be more reliable because it comprises fewer moving parts, i.e., it does not include steering rollers and moving pulleys found in conventional turn-up devices.

The present invention provides an apparatus and method for receiving flat articles having a top edge alignment and horizontal orientation and transporting the articles along a transport path to a vertical orientation and a bottom edge alignment. The apparatus comprises a frame, a deck plate adjustably mounted to the frame, and means for adjusting the position of the deck plate in a direction transverse to the paper path. A pair of entrance pulleys and exit pulleys are each mounted to the deck plate. The entrance pulleys rotate on a horizontal axis and the exit pulleys rotate on a vertical axis. First and second flexible, endless belts, are each wrapped around one of the entrance pulley and the exit pulleys wherein the belts complete a 90 degree twist from the respective entrance pulley to the respective exit pulley. The apparatus further comprises means for driving the exit pulleys to move the first and second belts in the same direction and at the same velocity for transporting the articles from the entrance location to the exit location, wherein the driving means is mounted under the deck plate.

DESCRIPTION OF THE DRAWINGS

The above and other objects and advantages of the present invention will be apparent upon consideration of the following detailed description, taken in conjunction with accompanying drawings, in which like reference characters refer to like parts throughout, and in which.

DETAILED DESCRIPTION OF THE PRESENT INVENTION

Figure 1:
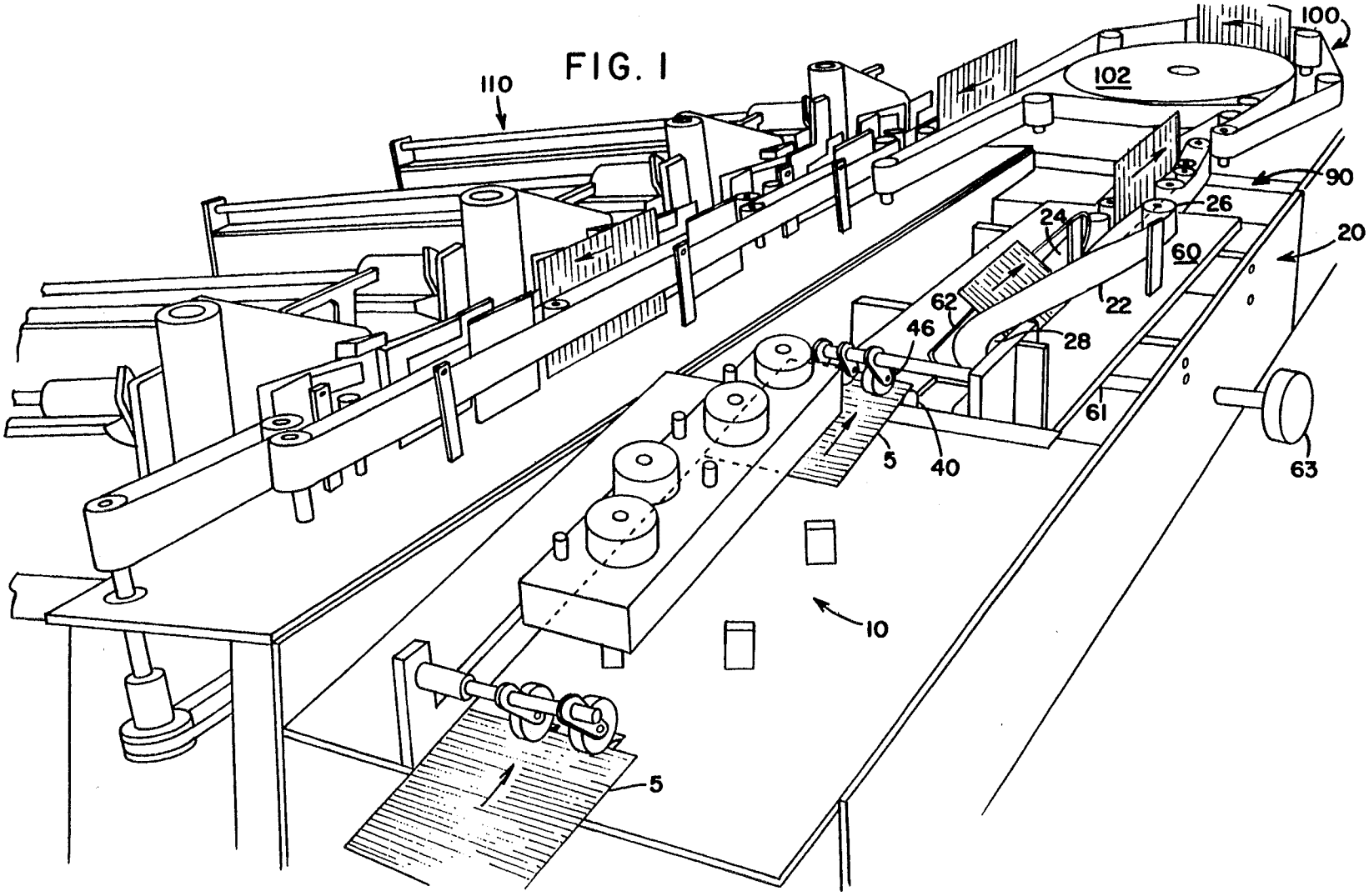
FIG. 1 is a perspective view from the entrance end of a turn-up and alignment device in accordance with the present invention.
Figure 2:
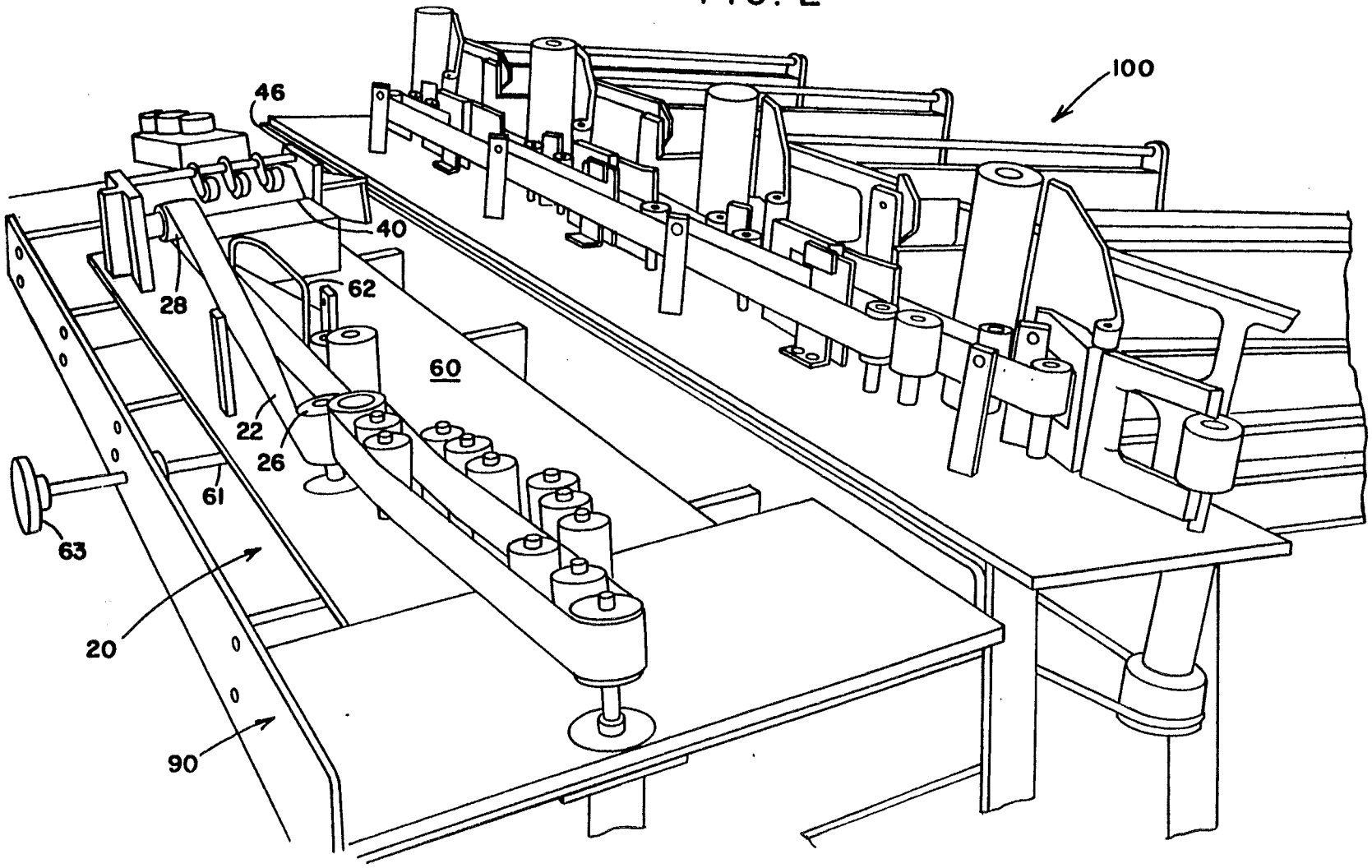
FIG. 2 is a perspective view from the exit end of the turn-up and alignment device of FIG. 1.

In describing the present invention, reference is made to the drawings, wherein there is seen in FIGS. 1–6 a turn-up and alignment device, generally designated 20, that can be utilized for simultaneously turning flat articles, such as envelopes, 90 degrees from a horizontal orientation to a vertical orientation and aligning the bottom edge of the articles. Device 20 is located downstream from any mail processing system, such as an inserting machine (not shown), from which a stuffed envelope exits in a horizontal orientation, traveling on its long axis.

Upstream of turn-up and alignment device 20 is a conventional alignment transport 10 which provides top edge registration of envelope 5 before the envelope is conveyed to device 20. Transport 10 is representative of many inserter finishing modules which process mailpieces horizontally with the top edge of each mailpiece aligned to a constant position. Transport 10 is fixed in position and outputs each mailpiece in a horizontal orientation. Alignment transport 10 also serves as an interface between the upstream mail processing system (not shown) and turn-up and alignment device 20. The output drive (not shown) of transport 10 is a conventional passive resistance drive, such as a one way clutch bearing, which allows envelope 5 to be pulled out by the drive of turn-up and alignment device 20. In the preferred embodiment of the present invention, turn-up and alignment device 20 operates at a velocity greater than that of alignment transport 10.

Turn-up and alignment device 20 includes two elastic, flat belts 22 and 24. Belt 22, which is the upper belt at the entrance end of device 20, is stretched around drive pulley 26 and idler pulley 28. Belt 24 is the lower belt that is stretched around carefully located drive pulley 30 and idler pulley 32. Idler pulleys 28 and 32 are both longitudinally and vertically disposed. Drive pulleys 26 and 30 are both longitudinally and laterally disposed. At the entrance end of turn-up and alignment device 20 lower belt idler pulley 32 is secured to a shaft 42. Also secured to shaft 42 is a roller 40. Roller 40 is driven by shaft 42 which is driven by lower belt pulley 26 and belt 24. A plurality of idler rollers 46 are mounted above roller 40 and are pivotally biased against roller 40. Another biased idler roller 48 (shown only in FIGS. 3–5) is mounted above pulley 32. The surface speed of idler 40 is the same as the surface speed of belts 22 and 24.

Roller 40 and belts 22 and 24 are continually driven at a higher velocity, for example 120 in/sec, than upstream alignment transport 10 so as to pull the envelope 5 from the transport 10. Preferably, the belts and rollers of turn-up and alignment device 20 are driven by a single motor 65 and a conventional belt and pulley drive system (FIG. 6), generally designated 64. In this manner, belts 22 and 24 and roller 40 operate at same speed.

Turn-up and alignment device 20 is mounted to a large rectangular deck plate 60 which is laterally adjustable according to the depth of the envelopes 5 being processed. A conventional lead screw/slide adjustment mechanism 61 is coupled to the underside of deck plate 60 for adjusting the position of turn-up and alignment device 20. A handle 63 is coupled to adjustment mechanism 61 for turning mechanism 61. This provides adjustment for bottom edge registration of envelope at the exit of the turn-up and alignment device 20. When exiting alignment transport 10 envelope 5 is top edge aligned in a horizontal orientation. Turn-up and alignment device 20 is positioned so as to deliver a bottom edge alignment of envelope 5 as envelope 5 is turned 90 degrees to a vertical orientation.

At the exit end of turn-up device 20 a pair of vertical belts 76 and 77 are stretched around idler pulleys 74 and 75 and drive pulleys 79 and 78 respectively. Groups of vertical, idler rollers 70, 71, 72 and 73 provide smooth contour guides for exit belts 76 and 77 as turn-up device 20 is positioned for handling different sized envelopes. The positions of the groups idler rollers 70, 71, 72 and 73 are based on sizes of envelopes and the positioning of deck plate 60 to handle a particular sized envelope. Idler pulleys 74 and 75 and idler pulleys 70 and 71 are mounted to deck plate 60. Idler pulleys 72 and 73 and drive pulley 78 are mounted to stationary transport modules described below. Belts 76 and 77 transport envelope 5 out of turn-up and alignment device 20. In the preferred embodiment of the present invention, when all three rollers in a group are engaged by belts 76 or 77, the belt forms an arc of at least a 5½ inch radius, which meets postal automation standards for mail handling.

Adjacent the downstream exit end of turn-up and alignment device 20 is a stationary vertical transport 90 having a deck plate 92 to which idler pulleys 72, 73 and 92 are rotatably mounted. Drive pulley 79 is mounted on a stationary deck plate 102 of drum transport 100 which is adjacent the exit end of transport 90. Transport 100 conveys envelope 5 to stacking unit 110. Preferably, drum 102 has a 16 inch diameter. Drum transport 100 is driven at the same velocity as turn-up and alignment device 20. Turn-up and alignment device 20 is suitable for interfacing with any on edge transport or stacking device that handles a fixed centerline of transport.

As mailpiece 5 is transported by belts 22 and 24, envelope 5 is in the control of the belts and thus follows the contour of belts 22 and 24. In this manner, mailpiece 5 goes from a horizontal orientation to a vertical orientation. A wire guide 62 acts as a plowing surface that assists in the turn-up of envelope 5. The contour of wire 62 follows twist of belts 22 and 24.

In conventional 90 degree turn-up devices a steering roller is strategically placed against each belt so as to prevent the belt from walking along the surface of the pulley and eventually sliding off the pulley when the belt moves through its 90 degree twisted contour. It has been found in the present invention that such use of steering rollers can be eliminated by longitudinally staggering the entrance and exit pulleys and providing the entrance, horizontal pulleys with offset crowns. The combination of very specific pulley location and proper crowning of drive/idler pulleys has eliminated the need for the additional complexity and associated cost of guiding rollers.

In accordance with the present invention, entrance pulleys 28 and 32 have offset crowns 80 and 82 respectively. Exit pulleys 26 and 30 have centerline crowns (not shown). Offset crowns 80 and 82 may be different, and are found by trial and error testing using the following criteria. First, all pulleys 26, 28, 30 and 32 are stationary in their respective rotational axis, i.e. the pulleys do not move in the y or z direction. Second, the entrance pulleys 28 and 32 and the exit pulleys 26 and 30 are longitudinally offset from each other respectively, i.e., the pulleys are offset in the x direction. This second criteria eliminates the need for any relative movement of the pulleys in handling envelopes having a variety of thicknesses. Third, the edges of belts 22 and 24 remain lined up with each other the entire 90 degree twist, i.e. the belts are not offset at any point during the turn-up movement. Fourth, exit pulleys 26 and 30 have centerline crowns. The foregoing criteria provide the needed equilibrium to maintain the belts on their respective pulleys without using steering rollers.

Once offset crowns 80 and 82 are separately determined for pulleys 28 and 32, belts 22 and 24 will track on their respective pulleys without the need for steering rollers. It has been found that once the offset crowns have been determined for pulleys 28 and 32, any movement of the pulleys in the y or z direction effects the tracking of belts 22 and 24 on their respective pulleys. However, movement of the pulleys in the x direction, i.e. the distance between the pulleys in x direction, does not effect the tacking of the belts.

The belt paths extend from horizontal, entrance pulleys 32 and 28 around vertical, drive pulleys 30 and 26. Each pair of entrance and exit pulleys is located in such a manner as to locate the belts directly on top of each other for the entire length of the 90 degree twist. Since pulleys 26, 28,30 and 32 are fixed in space, belt 22 and 24 stretch as envelope 5 is transported through the 90 degree turn-up. This aspect of the present invention provides a significant advantage over a conventional roller-to-roller nip which often generates a significant force pulse as flat articles, such as envelopes, are introduced. In the present invention the belt stretch produces the captivating force which transports the envelope along the length of the turn-up. This type of system eliminates the need for spring loaded idler arrangements that pivot and/or separate as envelopes having a variety of thicknesses are forced between two belts. By eliminating the need for such components the present invention comprises fewer parts, which, in turn, reduces complexity, and increases overall reliability.

As envelope 5 is transported beneath the stationary, upper, entrance pulley 28, lower belt 24 stretches and envelope 5 maintains its original horizontal orientation. The stretch of belt 24 creates the "nip" force as the envelope is accepted between the belts. As the envelope progresses past entrance pulley 28, it is influenced by the twisting contour of belts 22 and 24 and wire guide 62. By the time envelope 5 approaches exit pulleys 30 and 26, it has been manipulated to a substantially vertical orientation. (Exit pulleys 30 and 26 are longitudinally offset in such a manner as to exert the same "nip" force vertically as Entrance pulleys 32 and 28 do in the horizontal orientation.) There is a significant advantage in manipulating envelope 5 with the "soft nip" of elastic belts. The elastic belts form around and conform to the envelope even if the envelope is bulky or stiff without distorting the contents of the envelope.

In accordance with the present invention turn-up and alignment device 20 is laterally positioned so that any envelope entering it in a horizontal orientation from transport 10 is transported to a vertical orientation with its bottom edge justified to a common position. For example, if a size #10 envelope (4.125" deep) enters pulleys 32 and 28 with ½" of its bottom edge extending beyond belts 22 and 24, the envelope is turned up by the twist in the continuously moving belts with its bottom edge against deck plate 60 and transported to vertical transport 80 with its bottom edge registered. Comparatively, if a 6" deep envelope entered device 20 with ½ of its bottom edge extending beyond belts 22 and 24, it too transported to transport 80 with its bottom edge against deck plate 60.

Figure 3:
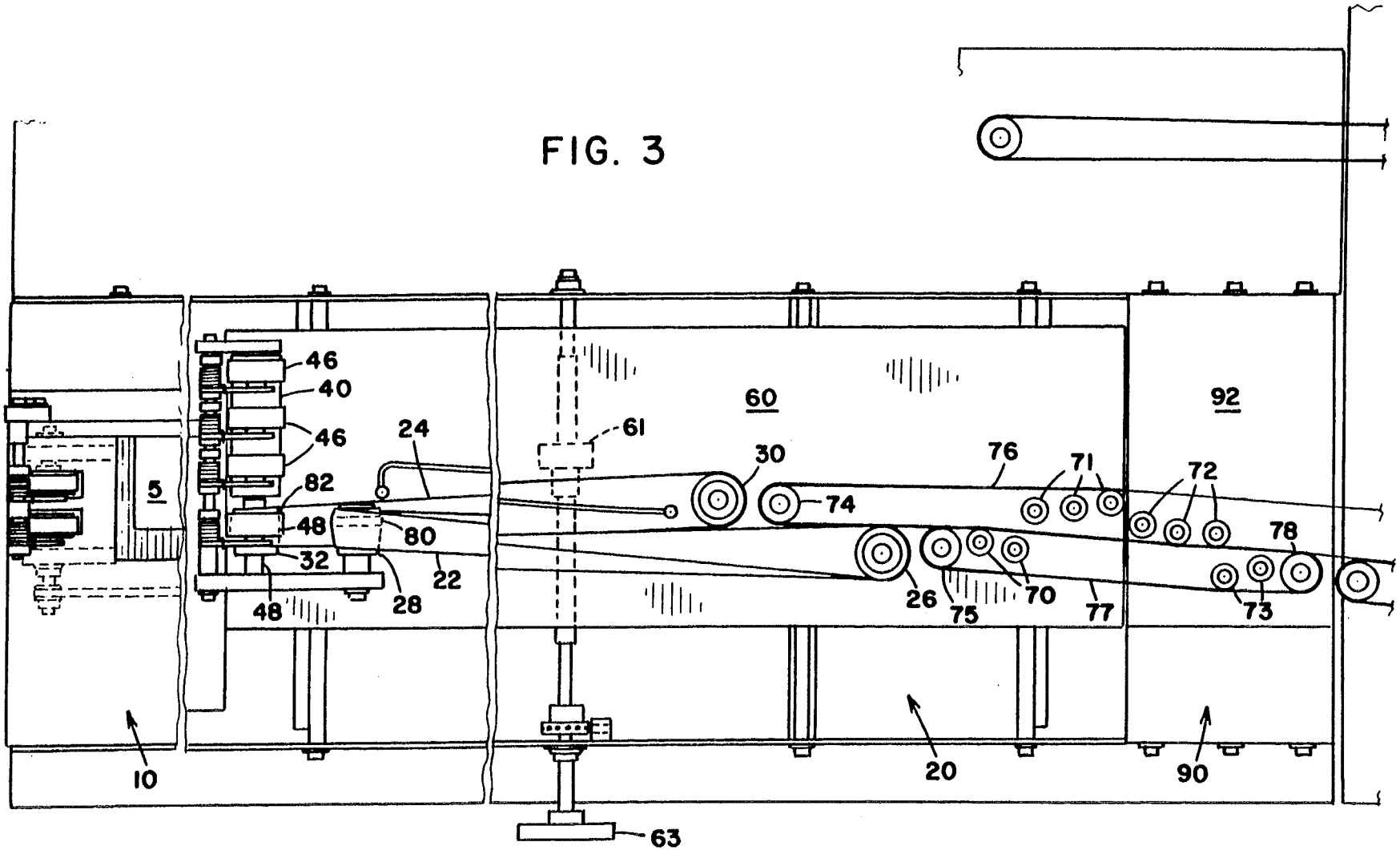
FIG. 3 is a top view of the turn-up and alignment device of FIG. 1 positioned for handling mid-size mailpieces.

Referring now to FIG. 3, turn-up and alignment device 20 is positioned to receive a #10 envelope 5 which is being transported along a horizontal plane by conventional alignment transport 10 at a top edge registered position. Belts 22 and 24 will receive envelope 5 with approximately ½" of the bottom edge of envelope 5 extending beyond the belts. When envelope 5 is transitioned to a vertical orientation by turn-up and alignment device 20 and transported to vertical transport 90, it will be bottom edge registered against deck 60. Envelope 5 will then continue through transport 90 and be delivered to some other finishing module having a fixed lateral centerline of transport. As shown in FIG. 1., envelope 5 will be transported around a drum 100 to a multi-bin stacking module, generally designated 110.

Figure 4:
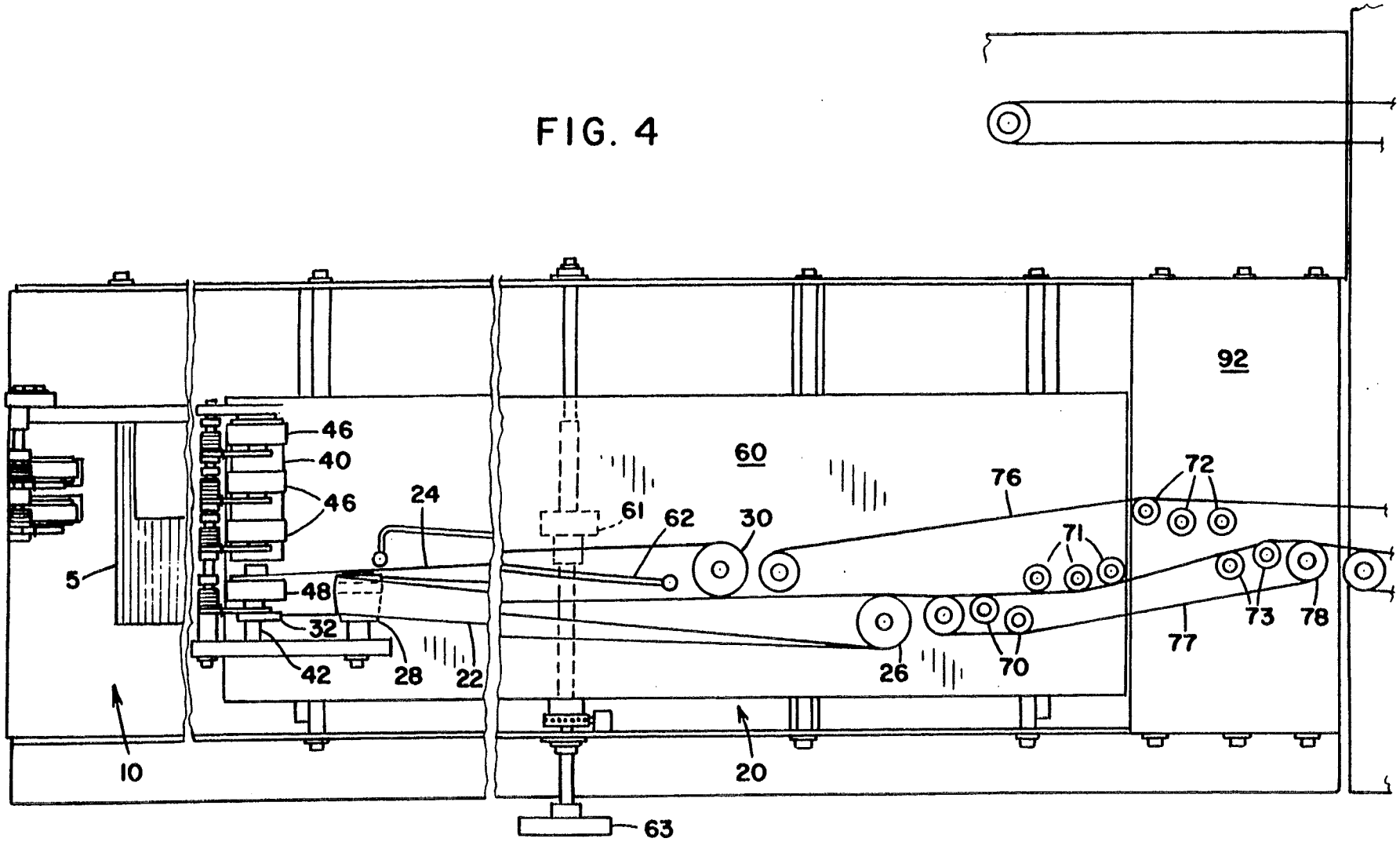
FIG. 4 is top view of the turn-up and alignment device of FIG. 1 positioned for handling large mailpieces.

Referring now to FIG. 4, turn-up and alignment device 20 is positioned to receive a 6.5" deep envelope 5 which is being transported along a horizontal plane by conventional alignment transport 10 at a top edge registered position. Note that the entire device 20 (on rectangular plate 60) has been adjusted downward (as shown in FIGS. 3 and 4) so that belts 22 and 24 accept the envelope approx. ½ inches above its bottom edge. It is through this adjustment the 6.5" deep envelope will end up bottom edge registered (vertical orientation) just as the #10 envelope in the previous example. When envelope 5 is transitioned to a vertical orientation by turn-up and alignment device 20 and transported to vertical transport 90, it will be bottom edge registered against deck 60. Envelope 5 will then continue through transport 90 and be delivered to some other finishing module having a fixed lateral centerline of transport. Note that Belts 76 and 77 are stretched appropriately against stationary idler pulleys 70, 71, 72 and 73 to provide a smooth contour of belts 76 and 77 when device 20 has been moved to a new lateral position for the 6.5" deep envelope. Belts 76 and 77 convey envelope 5 into a fixed transport centerline associated with the transport 90 and any downstream modules. Idler rollers 70, 71 , 72 and 73 have been strategically positioned to provide necessary drive forces between belts 76 and 77 and to provide a contoured belt path along the lateral mailpiece transition. The contoured belt path reduces any distorting forces that may otherwise be placed on the transported envelope 5. As previously describe idler rollers 70 and 71 are located on the movable deck plate 60 and idler rollers 72 and 73 are located on the fixed deck plate 92. The specific locations for rollers 70–73 provide the appropriate drive and contour characteristics as deck plate 60 is adjusted back and forth for various envelope sizes.

Figure 5:
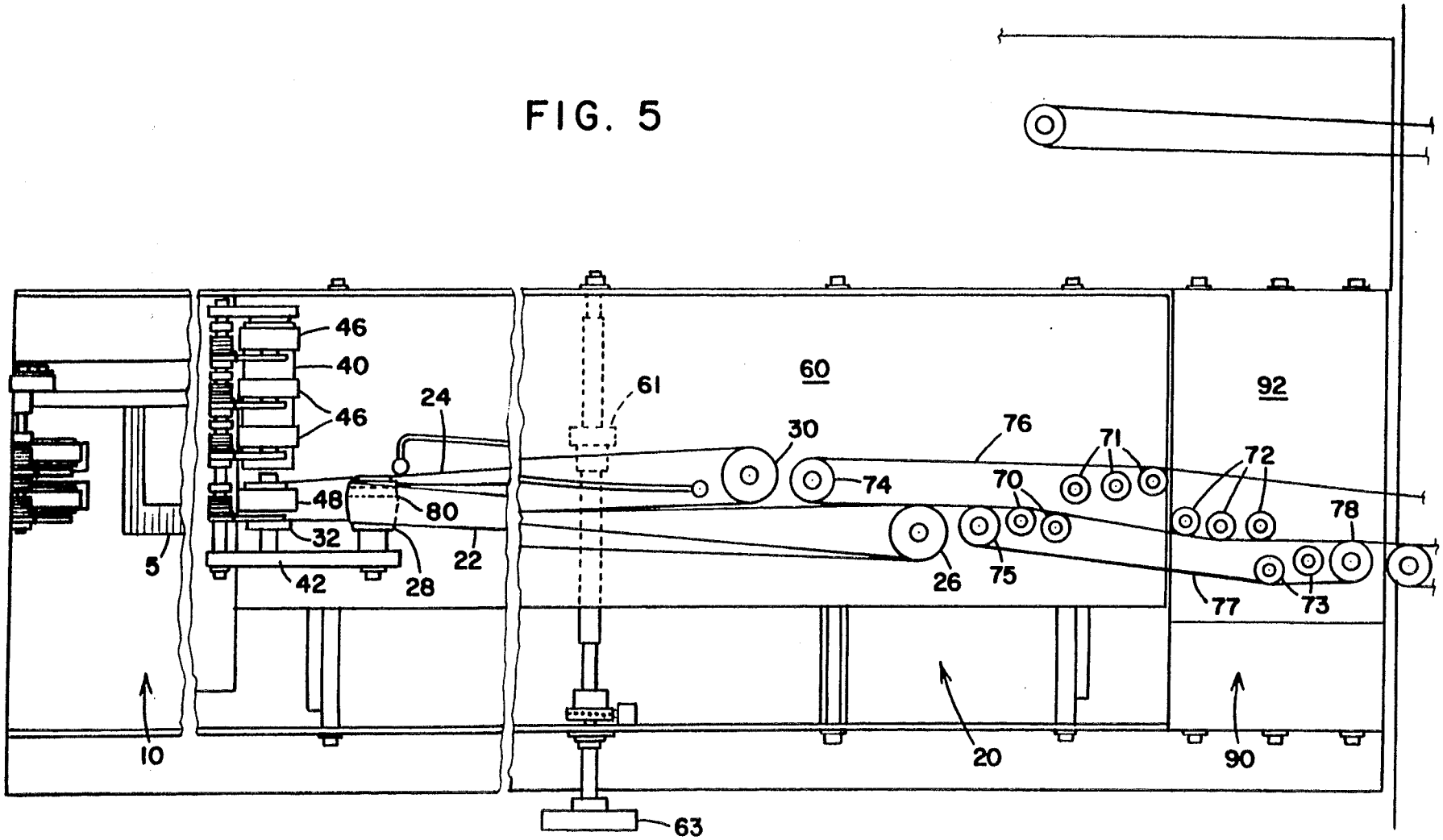
FIG. 5 is top view of the turn-up and alignment device of FIG. 1 positioned for handling small mailpieces.
Figure 6:
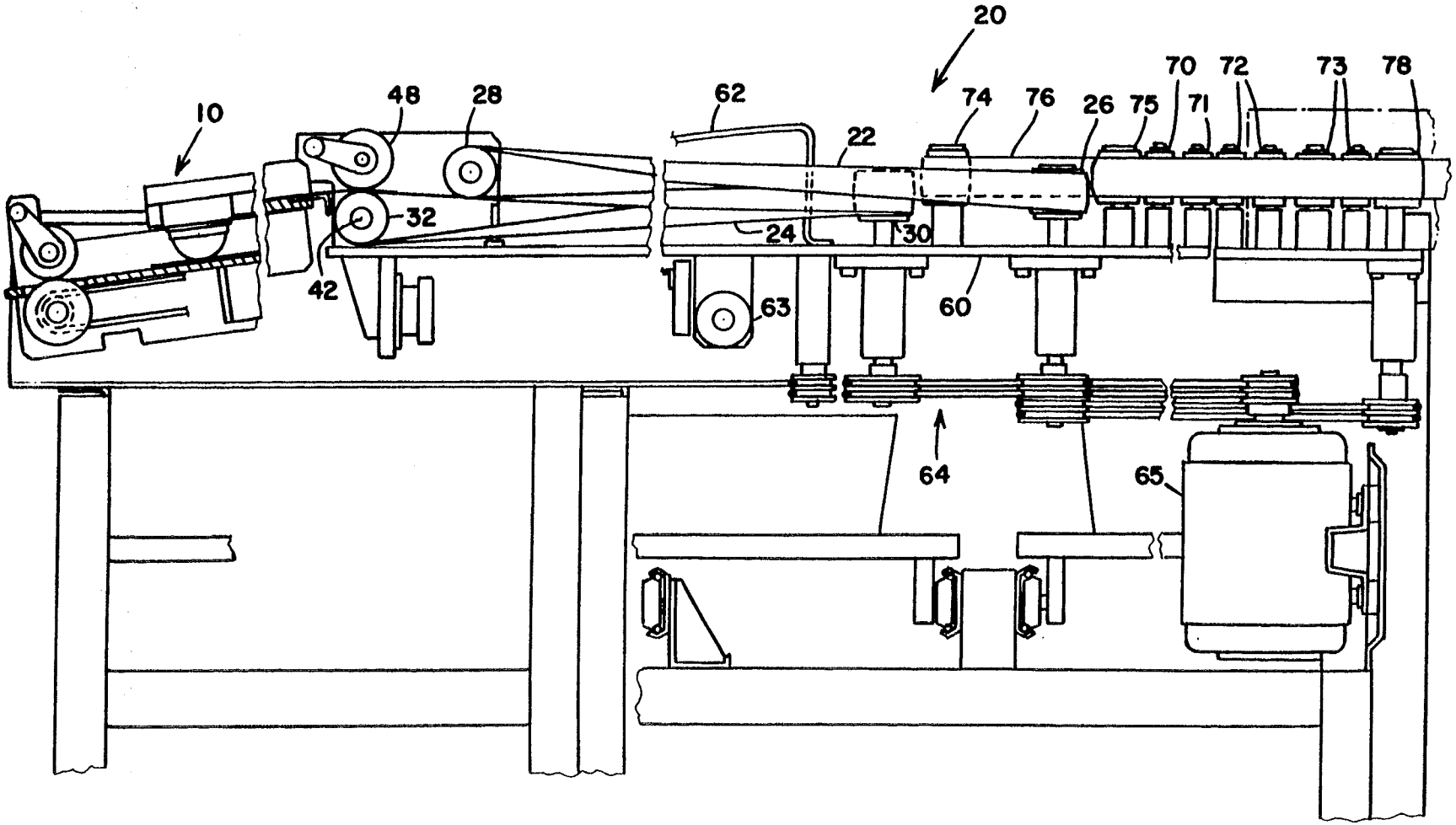
FIG. 6 is side view of the turn-up and alignment device of FIG. 1.
Figure 7:
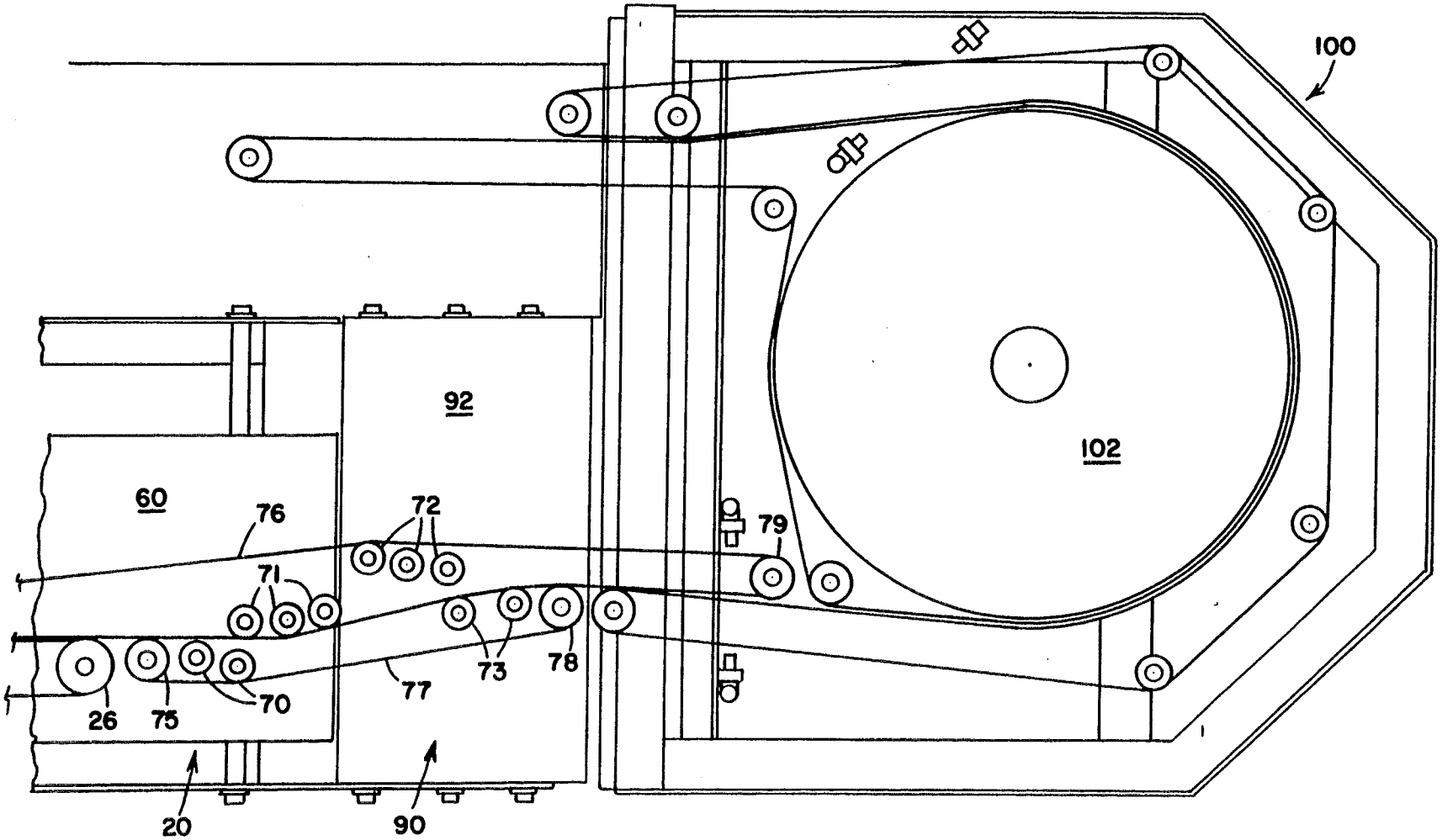
FIG. 7 is a top view of a drum transport at the exit end of the turn-up and alignment device of FIG. 1.

Referring now to FIG. 5, turn-up and alignment device 20 is positioned to receive a small 3.25" deep envelope from transport 10. Deck plate 60 has been adjusted up from the position in FIGS. 3 and 4, so that belts 22 and 24 accept envelope 5 approximately ½ inches above its bottom edge. Similar to the previous examples, the 3.25" deep envelope will also be accepted by transport 90 with its bottom edge registered against the deck. Belts 76 and 77 which have been stretched appropriately to maintain an interface with belts 22 and 24 will then adjust the lateral position of the mailpiece to the fixed centerline required for downstream processing.

In addition to the simplicity and cost-effectiveness of the present invention, there are additional advantages to this invention when compared to current art. The present invention simultaneously bottom edge justifies as the envelope is being turned. As previously noted, conventional bottom edge alignment of an article that is output top edge aligned require relative motion between the transport means and the envelopes being processed. The present invention eliminates such relative forces that might disturb the mailpiece. Also, the present invention maintains constant control of the mailpiece in dual belts without needing to skid it with very little control along a surface. Constant mailpiece control is critical to a exceptional paper handling and a highly reliable system.

Conventional alignment devices have a basic problem when realigning the smallest articles from top edge registration to bottom edge registration. In realigning a 3" top registered document to a bottom edge registration over a 8" deep deck, the 3" document would need to travel 5" (along its depth dimension) before it registers against the bottom registration surface. A 7" deep top edge registered document would only have to travel 1" along its depth dimension to be realigned. Thus conventional alignment devices are not really suited for handling various sizes of envelopes that must be realigned to bottom edge registration. The present invention maintains lateral movement about a centerline position so that the smallest (or largest) mailpieces only have to adjust ½ the total span. And in these cases the adjustment is made in dual belted transports which is an extremely reliable paper handling maneuver.

A final advantage of the proposed invention is with respect to overall module length. Since a traditional aligner could not begin to affect a mailpiece until it had been completely removed from any upstream module such as transport 10, the alignment module needs to be the length needed to align the mailpiece in addition to the length of the longest mailpiece. The present reduces the overall module length because a separate alignment device has been eliminated.

While the present invention has been disclosed and described with reference to a single embodiment thereof, it will be apparent, as noted above that variations and modifications may be made therein. It is also noted that the present invention is independent of the machine being controlled, and is not limited to the control of inserting machines. It is, thus, intended in the following claims to cover each variation and modification that falls within the true spirit and scope of the present invention.

What is claimed is:

1. Apparatus for receiving flat articles having a top edge alignment and horizontal orientation and transporting the articles along a transport path to a vertical orientation and a bottom edge alignment, comprising:

a frame;

a deck plate adjustably mounted to said frame;

means for adjusting the position of said deck plate in a direction transverse to the paper path;

a pair of entrance pulleys and exit pulleys each mounted to said deck plate, said entrance pulleys rotating on a horizontal axis and said exit pulleys rotating on a vertical axis; and first and second flexible, endless belts, each of said belts being wrapped around one of said entrance pulley and said exit pulleys wherein said belts complete a 90 degree twist from the respective entrance pulley to the respective exit pulley.

2. The apparatus of claim 1 wherein said adjusting means comprises a lead screw/slide adjustment mechanism coupled to the underside of said deck plate.

3. The apparatus of claim 1 further comprising means for driving said exit pulleys to move said first and second belts in the same direction and at the same velocity for transporting the articles from the entrance location to the exit location, wherein said driving means is mounted under said deck plate.

4. The apparatus of claim 1 wherein each of said entrance pulleys have an offset crown and said entrance pulleys are longitudinally and vertically apart from one another such that one of said entrance pulleys functions as lower entrance pulley and the other entrance pulley functions as an upper entrance pulley, said upper entrance pulley being located downstream from said lower entrance pulley.

5. The apparatus of claim 4 wherein each of said exit pulleys have a centerline Crown and one of said exit pulleys is located downstream from an upstream one of said exit pulleys.

6. The apparatus of claim 5 further comprising a plurality of idler rollers against said lower entrance roller and said lower idler pulley.

7. The apparatus of claim 1 further comprising means for guiding flat articles that are transported by the belts through the ninety degree twist.

8. The apparatus of claim 1, further comprising a lower entrance roller adjacent said lower entrance pulley and rotating on the same horizontal axis as said lower pulley.

9. The method of turning flat articles received top edge aligned in a horizontal orientation ninety degrees to a vertical orientation, comprising the steps of:

providing an adjustably positioned deck plate that can be laterally moved to a desired position;

mounting a ninety degree turn-up transport to said deck plate;

providing said ninety degree turn-up transport with a vertical transport section having belts situated approximately ½ inches above said deck plate; and positioning said deck plate such that said ninety degree turn-up transport receives the flat articles in a horizontal entrance section with the bottom edge of the flat article extending approximately ½ inches from the belts.

* * * * *